US009994433B2

(12) United States Patent
Guo et al.

(10) Patent No.: US 9,994,433 B2
(45) Date of Patent: Jun. 12, 2018

(54) BRAKE/CLUTCH DEVICE FOR MANUAL HOIST

(71) Applicant: JPW Industries Inc., LaVergne, TN (US)

(72) Inventors: Qi-Rong Guo, Chongqing (CN); Xiang-Nian Fu, Chongqing (CN)

(73) Assignee: JPW Industries Inc., LaVergne, TN (US)

( * ) Notice: Subject to any disclaimer, the term of this patent is extended or adjusted under 35 U.S.C. 154(b) by 200 days.

(21) Appl. No.: 15/046,565

(22) Filed: Feb. 18, 2016

(65) Prior Publication Data

US 2017/0240395 A1 Aug. 24, 2017

(51) Int. Cl.

| | |
|---|---|
| ***B66D 5/00*** | (2006.01) |
| ***B66D 5/14*** | (2006.01) |
| ***B66D 1/04*** | (2006.01) |

(52) U.S. Cl.

CPC ..... *B66D 5/14* (2013.01); *B66D 1/04* (2013.01); *B66D 2700/023* (2013.01)

(58) Field of Classification Search

CPC ... B66D 1/04; B66D 5/12; B66D 5/14; B66D 2700/023

See application file for complete search history.

(56) References Cited

U.S. PATENT DOCUMENTS 4,420,144 A * 12/1983 Nishimura ..... B66D 3/14 254/345
4,436,333 A * 3/1984 Tsuda ..... B66D 3/16 254/358
4,768,754 A * 9/1988 Nishimura ..... B66D 1/58 254/351
5,088,694 A * 2/1992 Nishimura ..... B66D 3/14 254/352
5,238,226 A * 8/1993 Nishimura ..... B66D 3/14 254/352
5,305,989 A * 4/1994 Nishi ..... B66D 3/14 254/352
5,472,171 A * 12/1995 Nishi ..... B66D 3/14 254/352
5,535,988 A * 7/1996 Nishimura ..... B66D 3/14 254/352
5,641,151 A * 6/1997 Kataoka ..... B66D 3/14 192/111.1
6,554,255 B2 * 4/2003 Fujikawa ..... B66D 3/14 254/342

(Continued)

*Primary Examiner* — Emmanuel M Marcelo

(74) *Attorney, Agent, or Firm* — Walker Lansden Dortch & Davis, LLP; Blake M. Bernard

(57) ABSTRACT

A brake/clutch device for a manual hoist provides an externally-viewable indicator showing the wear status of friction elements within the hoist. The brake/clutch device has a brake block, a brake ratchet, a reversing ratchet, a torsion spring block, a hand wheel and a fastener mounted onto a main shaft of the manual hoist. Friction elements on the brake ratchet provide braking against sudden drops of a load. Ball and spring devices mounted in the hand wheel contact detents and grooves that gradually increase in depth in the torsion spring block depending on the relative positions of the hand wheel and the torsion spring block. The hand wheel has an indicator mark that may align with indicator areas of the torsion spring block to indicate an extent of wear of the friction elements.

8 Claims, 4 Drawing Sheets

(56) References Cited

U.S. PATENT DOCUMENTS

| | | | | |
|---|---|---|---|---|
| 6,578,824 | B2 * | 6/2003 | Samejima | B66D 3/10<br>254/352 |
| 6,883,784 | B1 * | 4/2005 | Sloneker | B66D 1/04<br>254/366 |

* cited by examiner

BRAKE/CLUTCH DEVICE FOR MANUAL HOIST

CROSS-REFERENCE TO RELATED APPLICATION

This application claims priority of Chinese Patent Application No. CN201410793832.3 filed Dec. 18, 2014, and Chinese Utility Model Application No. CN201420810298.8 filed Dec. 18, 2014, both of which are incorporated herein by reference.

BACKGROUND OF THE INVENTION

Field of the Invention

The present invention relates generally to a hoist and method for hoisting a load, and more particularly to a brake/clutch device of a manual hoist and method.

Description of the Related Art

A manual hoist is a device that may be used for vertically lifting or lowering a load or for exerting a pulling force on a load. The hoist is operated by manually moving a lever of the hoist. The force applied to the lever is transformed by the hoist into a linear traction force that is applied to the load to achieve up-and-down movement of the load. As manual hoists have a small size and light weight, they are readily portable, readily operable and suitable for small tonnage loads.

Existing manual hoists typically have a brake ratchet, a friction disk, a reversing ratchet, and a positioning component that are disposed successively on their long shafts, and the reversing ratchet and the long shaft are connected by threads. When lifting a load, a reversing ratchet pawl on the lever is first turned to engage with the reversing ratchet. When turning the lever, the lever may be allowed to drive the reversing ratchet to rotate. As the reversing ratchet is in threaded connection with the long shaft, when the reversing ratchet rotates circumferentially it moves axially to press against the friction disk, causing the brake ratchet to rotate clockwise; when it is reversed, braking will be achieved to prevent the load from dropping suddenly. When lowering a load, the reversing ratchet pawl is turned to cause the other end thereof to engage with the reversing ratchet, and turning the lever anticlockwise will achieve lowering of the load.

Chinese Invention Patent No. 200720111423.6 discloses a controlling/braking/clutching device of a manual hoist. Based on existing manual hoists, the device allows a circumferential compressive force to be applied to the braking mechanism to cause the braking mechanism to brake when the chain of the manual hoist needs to be raised while the manual hoist is in idle mode. When the manual hoist needs to be lowered rapidly while it is in idle mode, the compressive force may be released so that the chain can be rapidly raised or lowered.

However, the aforementioned manual hoists have the following problems: as the friction disk is a core component of the entire manual hoist; the friction disk is not only related to braking during the lifting and lowering of loads but also to operation of the hoist. A worn braking component is serious and may result in the hoist being prone to failure, which may cause accidents. As the friction disk is located within the housing of the manual hoist, the housing must be dismantled to determine the degree of wear of the friction disk. Therefore, regular safety inspections to determine the degree of wear of the friction disks of these manual hoists are required, but dismantling and re-assembling the hoists on a regular basis are very troublesome.

SUMMARY OF THE INVENTION

Certain aspects of the present invention aim to overcome the inconvenience of dismantling a manual hoist to inspect the degree of wear of the friction disk or brake pad of a prior art manual hoist by providing a braking/clutching device of a manual hoist, the braking/clutching device enabling real-time observation of the degree of wear of a friction disk or brake pad without having to dismantle the manual hoist. The braking/clutching device is safe and convenient because when the brake pad wear is excessive, the manual hoist can be promptly dismantled and one or more friction disks or brake pads can be replaced.

To this end, the apparatus and method of the present invention provides:

A braking/clutching device of a manual hoist, comprising: a brake block, a brake ratchet, a reversing ratchet, a torsion spring block, a hand wheel, and a fastener that are circumferentially disposed successively on a long shaft or main shaft of the manual hoist, with the brake block fixing one end of the assembly and the fastener fixing the other end thereof; wherein: the brake block and the long shaft are fixed circumferentially; both sides of the brake ratchet are each provided with a friction disk; the reversing ratchet and the long shaft are connected by threads; the torsion spring block and the reversing ratchet are fixed circumferentially by a bayonet or other connection; a torsion spring is sheathed on the long shaft at a position located between the torsion spring block and the hand wheel, with one end of the torsion spring coupled to the torsion spring block and the other end of the torsion spring coupled to the hand wheel; ball and spring devices, or spring balls, are disposed between the torsion spring block and the hand wheel and are embedded in the hand wheel, and concave detents, dents, or indentations, are provided on an end face of the torsion spring block; the hand wheel and the long shaft are fixed circumferentially; an indicator point is provided on a surface of the hand wheel for indicating the relative positional change between the hand wheel and the torsion spring block, and an indicator area is provided on an end face of the torsion spring block for indicating the positional change of the indicator point.

Preferably, the indicator area includes an initial state area, an operating state area and a worn state indicator area which are successively disposed circumferentially on the torsion spring block.

Preferably, the end face of the torsion spring block is further provided with concave grooves that are circumferentially disposed adjacent to the concave detents with the depth of the concave grooves gradually increasing from the respective adjacent concave detents; the concave detents correspond to the initial state area, and the concave grooves correspond to the operating state area and the worn state indicator area.

Preferably, the brake block is fixed on the long shaft by the steps in the long shaft, and the fastener is a threaded nut that is threaded onto the long shaft.

Preferably, the brake block and the long shaft are connected to one another by a splined connection, and the hand wheel and the long shaft are also connected to one another by a splined connection.

Preferably, the circumferential surface of the torsion spring block includes knurled portions.

Preferably, the concave detents or dents are round holes that are provided with bushings to accommodate the ball and spring devices.

Preferably, the brake ratchet is fitted on the brake block using a ratchet bushing.

Due to the adoption of the aforementioned technical scheme, certain aspects of the present invention have the following beneficial effects:

A braking/clutching device of a manual hoist of the present invention provides an indicator point or other indicator on the hand wheel and an indicator area on the torsion spring block, and thus enables observation of the relative positional change between the hand wheel and the torsion spring block to thereby determine the degree of wear of the friction disks in the housing or shell of the manual hoist simply, intuitively and conveniently without having to dismantle the manual hoist. The device also provides concave grooves having gradually increasing depth to reduce the relative resistance between the hand wheel and the torsion spring block, so as to accurately indicate the relation positional change between the hand wheel and the torsion spring block.

When the indicator point or other indicator of the hand wheel is aligned in the operating state area of the indicator area on the torsion spring block, the reversing ratchet is urged to constantly press against the friction disks due to the effect of the torsion spring, and when there is no load the lever may be directly turned or moved to raise the hoist chain without having to manually pull up the hoist chain to provide a lifting or lowering force.

When the indicator point of the hand wheel is aligned in the initial state area of the indicator area on the torsion spring block, the hoist chain may be rapidly lowered in an idle mode. If the acceleration of the lowering hoist chain becomes too large, then the reversing ratchet cannot rotate coaxially with the long shaft and the reversing ratchet will automatically rotate inwardly toward the long shaft to abut the friction disk, and the indicator point of the hand wheel will automatically indicate the wear status of the friction disks at the operating state area, hence forming an automatic braking mechanism to prevent potential safety hazards caused by any excessive acceleration of the lowering hoist chain in the idle mode and indicating the wear status of the brake pads.

When the indicator point of the hand wheel is in the operating state area of the indicator area on the torsion spring block and the load being lowered is relatively light, the indicator point of the hand wheel is configured to indicate at the initial state area of the indicator area to achieve rapid lowering of loads to prevent operation errors and thereby preventing accidents.

DETAILED DESCRIPTION OF THE PREFERRED EMBODIMENTS

Figure 1:
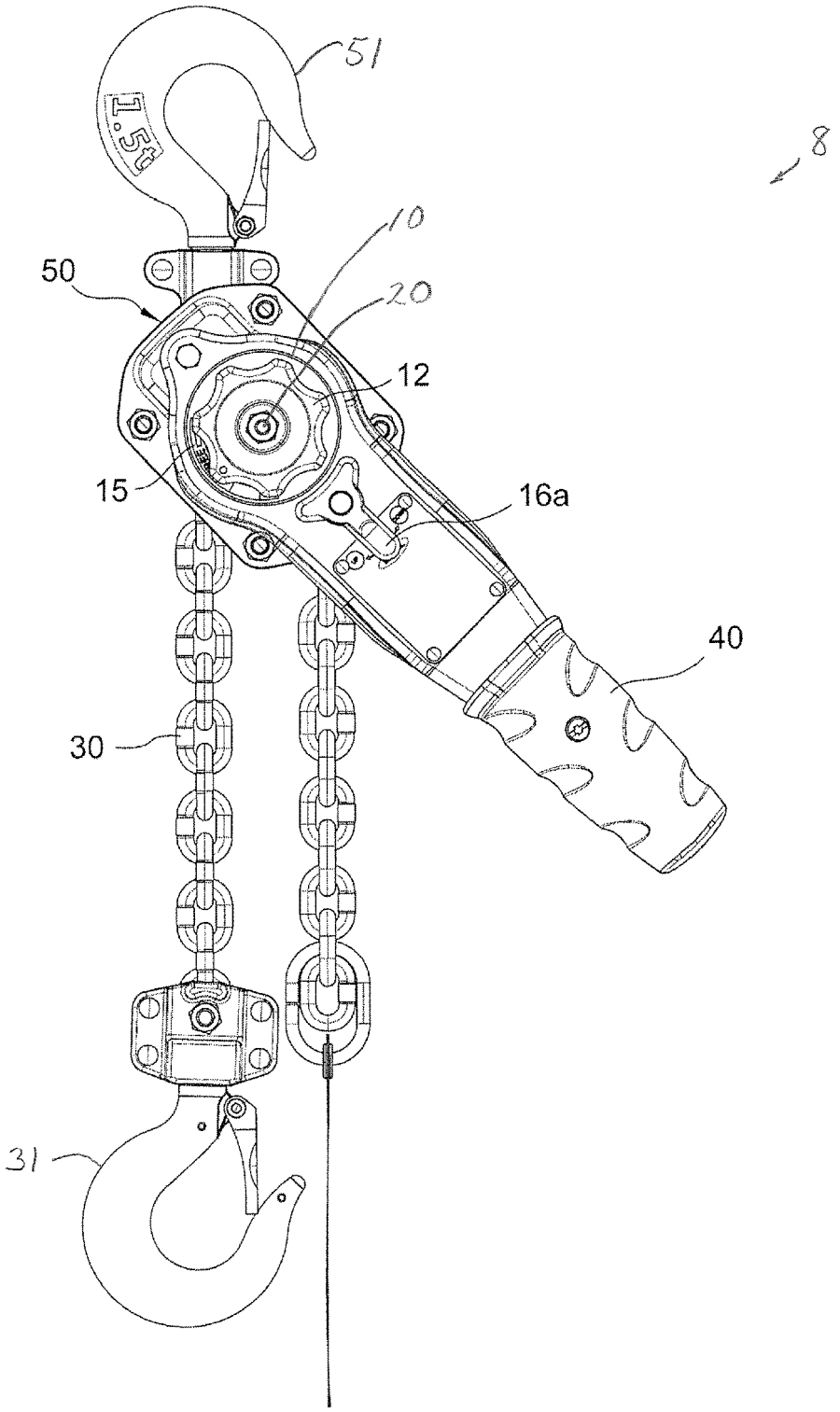
FIG. 1 is a front elevational view of a manual hoist of the present invention.
Figure 2:
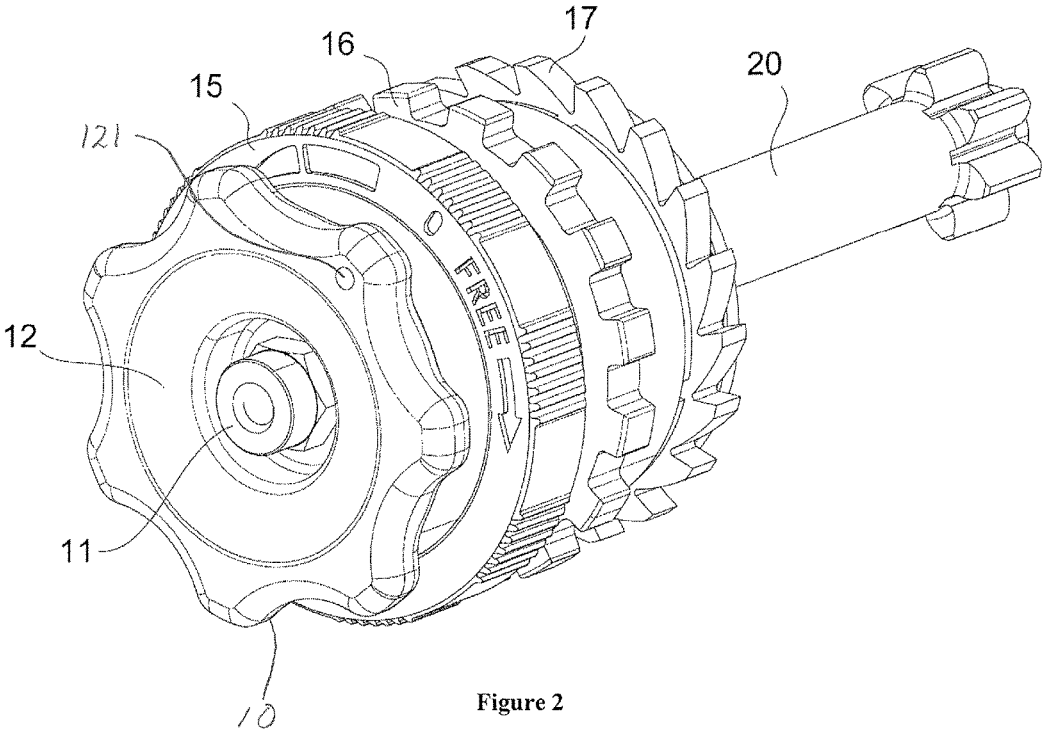
FIG. 2 is a perspective view of a braking/clutching device of the present invention which may be used in a manual hoist as shown in FIG. 1.

Referring to FIG. 1 and FIG. 2, a manual hoist 8 of the present invention includes a main body 50 through which a long shaft, or main shaft, 20 passes. The long shaft or main shaft 20 has mounted successively thereon a braking/clutching device 10, a lever 40 and a gear transmission mechanism (not shown, as it is behind the lever 40 in the view of FIG. 1). The main body 50 has a mounting hook 51 by which the main body is supported. The gear transmission mechanism is provided with a hoist chain 30 disposed thereon. The hoist chain 30 is provided with a load hook 31 that may be connected to a load. The braking/clutching device 10 is driven by means of the lever 40 to thereby cause the long shaft 20 to rotate and, when the long shaft 20 rotates, the gear transmission mechanism at the end the long shaft 20 is driven to rotate and cause the gear transmission mechanism to raise or lower the hoist chain 30, thereby achieving lifting or lowering of loads. The hoist 8 is operated by moving the lever 40 in an arc or pivot motion about its pivot axis.

Figure 3:
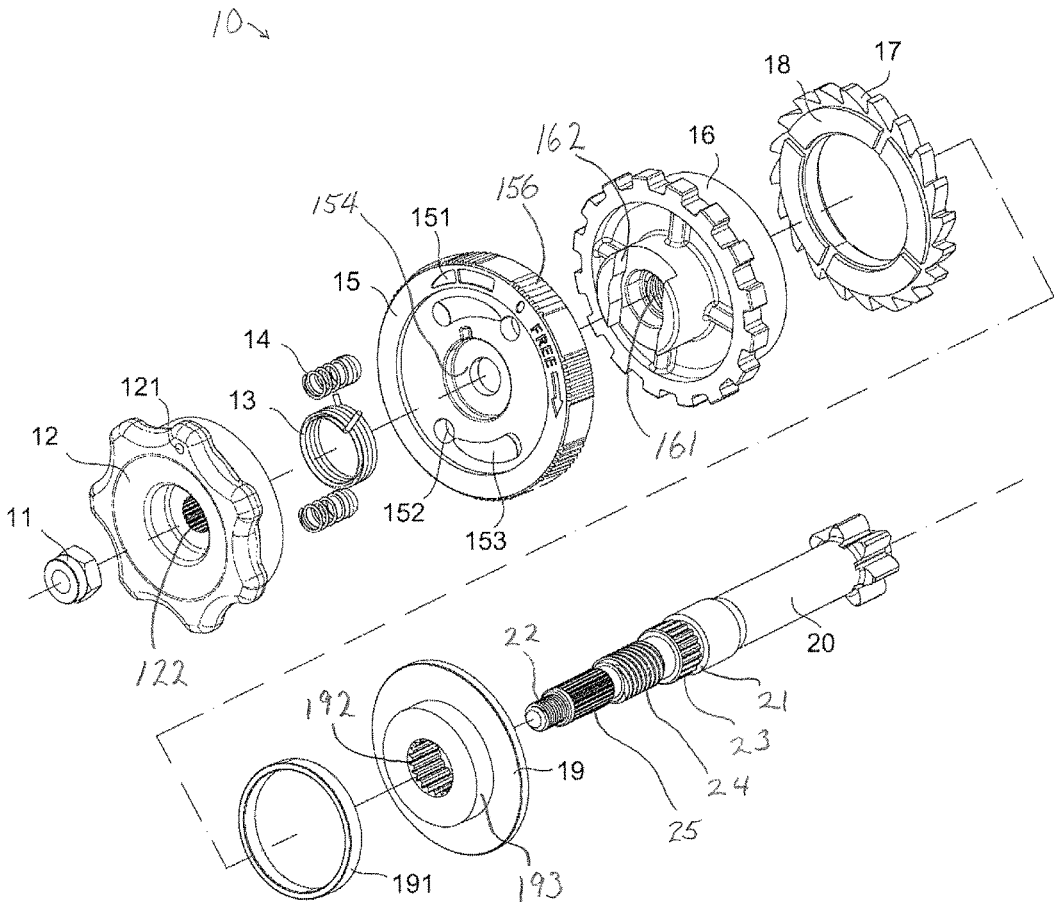
FIG. 3 is an exploded schematic view of the braking/clutching device of FIG. 2.
Figure 4:
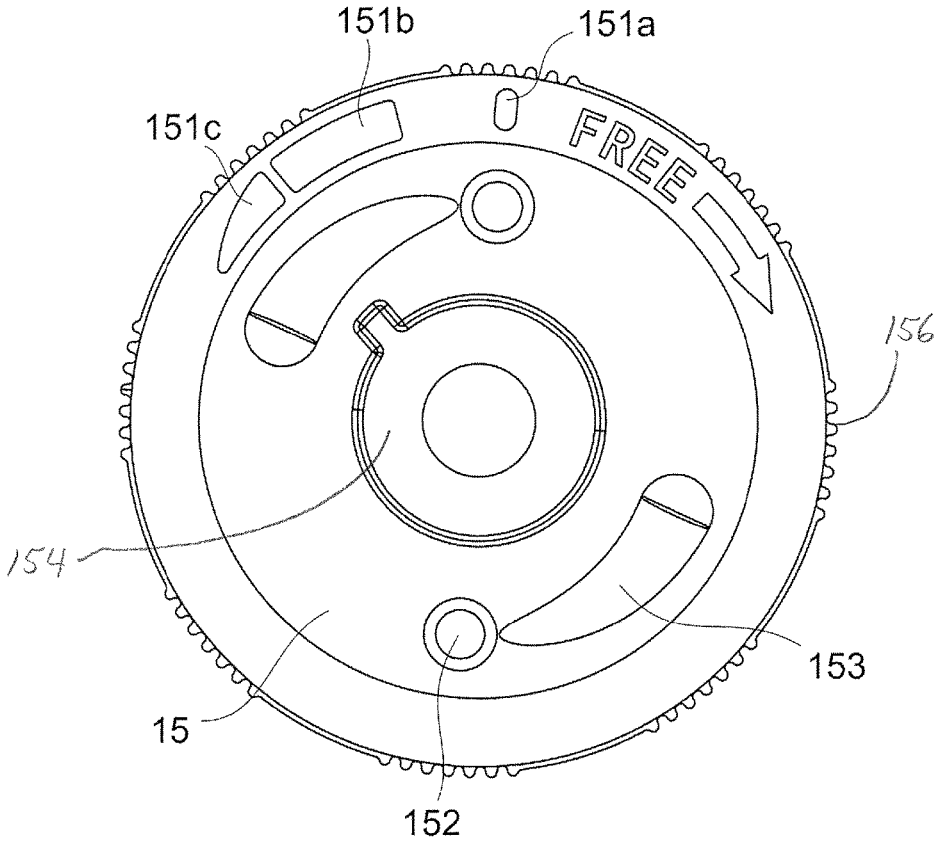
FIG. 4 is a side elevational view of a torsion spring block of FIGS. 2 and 3.

Referring to FIG. 2, FIG. 3 and FIG. 4, the braking/clutching device 10 of the manual hoist of the present invention comprises a brake block 19, a brake ratchet 17, a reversing ratchet 16, a torsion spring block 15, a hand wheel or knob 12 and a fastener 11 that are disposed circumferentially and successively on the long shaft 20 of the manual hoist 8. The brake block 19 fixes one end of the assembly of the brake block 19, the brake ratchet 17, the reversing ratchet 16, the torsion spring block 15, the hand wheel 12 and the fastener 11 on the long shaft 20 and the fastener 11 fixes the other end of the assembly on the long shaft 20. The brake block 19 is fixed in place on the long shaft 20 by steps 21 formed on the long shaft 20, and the fastener 11 is a threaded nut that is threaded onto a threaded portion 22 of the long shaft 20. The brake block 19 and the long shaft 20 are connected to one another by a splined connection that includes splines 23 on the long shaft 20 on which fits splines 192 of the brake block 19 to thereby achieve circumferential fixation of the two parts to one another.

Both sides of the brake ratchet 17 are each provided with a friction disk or brake pad 18. The friction disk or brake pad 18 is shown here as a ring of friction material that is formed with four segments and mounted on the brake ratchet 17. Other shapes are of course possible. A ratchet bushing 191 is mounted onto an axially extending cylindrical projection 193 of the brake block 19 and the brake ratchet 17 is fit onto the ratchet bushing 191. The reversing ratchet 16 and the long shaft 20 are connected to one another by threads 24 and 161. The torsion spring block 15 and the reversing ratchet 16 are fixed circumferentially by a bayonet connection or other connection 162 that may prevent the parts from rotating relative to one another. A torsion spring 13 is sheathed on or fitted onto the long shaft 20 at a position located between the torsion spring block 15 and the hand wheel 12, with one end of the torsion spring 13 coupled to the torsion spring block 15 in a recess 154 and the other end of the torsion spring 13 coupled to the hand wheel 12, for example in a comparable recess.

Steel ball and spring device (which may be referred to as ball nose spring plungers or spring balls) 14 are disposed between the torsion spring block 15 and the hand wheel 12 and are fitted into openings in the hand wheel 12. Concave detents, dents, or indentations, 152 are provided on an end face of the torsion spring block 15 at locations corresponding to the ball and spring devices. The concave detents 152 are round holes provided with bushings which can be selected according to the size of the ball of the ball and spring devices to ensure that the steel ball and spring devices provide a constant pressure. In certain examples of the present device, 8 mm steel balls are used in the ball and spring devices.

The hand wheel 12 and the long shaft 20 are connected to one another by a splined connection that includes a splined portion 25 on the shaft 20 and splines 122 in the hand wheel to thereby achieve circumferential fixation between the parts.

An indicator point or other indicator 121 is provided on a surface of the hand wheel 12 for indicating the position of the hand wheel so that any positional changes between the hand wheel 12 and the torsion spring block 15 will be apparent to a user. An indicator area 151 is provided on an end face of the torsion spring block 15 adjacent where the indicator 121 of the hand wheel 12 may be positioned for alignment between the indicator point of the hand wheel 12 and the indicator area 151 of the torsion spring block. A position of the hand wheel indicator 121 relative to the indicator area 151 may be examined without opening a housing of the hoist 8. Any positional change of the torsion spring block 15 relative to the indicator point 121 is indicated to a user. The indicator area 151 includes an initial state indicator area 151*a*, an operating state indicator area 151*b* and a worn state indicator area 151*c* which are successively disposed circumferentially on the torsion spring block 15. The circumferential surface of the torsion spring block 15 is knurled at 156 to facilitate rotation of the torsion spring block 15 by a user.

When the manual hoist 8 is in an initial state, the indicator point 121 of the hand wheel 12 is aligned at the operating state area 151*a* of the indicator area 151 on the torsion spring block 15 (as shown in FIG. 2), while the ball portions of the ball and spring devices 14 in the hand wheel 12 are located in the concave detents 152 on the torsion spring block 15, thereby causing the hand wheel 12 and the torsion spring block 15 to be relatively Fixed to each other. In other words, the force of the balls in the detents 152 prevents rotation unless sufficient force is exerted on the parts to move the ball and spring devices out of the detents 152.

The operating principles of the manual hoist 8 of the present invention are as follows:

When lifting a load, a reversing ratchet pawl controlling end 16*a* on the lever 40 is first turned to the "UP" mode so that the reversing ratchet pawl on the lever 40 is engaged with the reversing ratchet 16, and the torsion spring block 15 is then held stationary with a hand of a user and the hand wheel 12 is rotated with another hand of a user. When in an initial state, the indicator point 121 of the hand wheel 12 is aligned with the initial state area 151*a* of the indicator area 151 on the torsion spring block 15. After being rotated anticlockwise the indicator point 121 is aligned with the central position of the operating state area 151*b* of the indicator area 151.

In this embodiment, as shown in FIG. 1 and FIG. 4, the hook 31 of the hoist chain 30 is located on the left side; the threads on the long shaft 20 corresponding to the reversing ratchet 16 are right-hand threads. The initial state area 151*a*, the operating state area 151*b* and the worn state area 151*c* are successively arranged anticlockwise. As the hand wheel 12 and the long shaft 20 are connected by a splined connection, when the hand wheel 12 is rotated anticlockwise the long shaft 20 also rotates anticlockwise. As the long shaft 20 and the reversing ratchet 16 are connected by threads, when the long shaft 20 is rotated anticlockwise the reversing ratchet 16 is made to move toward the brake ratchet 17, thereby pressing against the friction disk 18 to achieve pre-tightening. Thereafter, the lever 40 is turned again to control clockwise rotation of the reversing ratchet 16, at which time the hand wheel 12, the torsion spring block 15, the reversing ratchet 16, the brake ratchet 17 and the long shaft 20 are integrated as one and rotate simultaneously to lift the load. At the same time, if the load causes the long shaft 20 to rotate anticlockwise, braking of the long shaft 20 can be achieved by the friction disk 18 between the reversing ratchet 16 and the brake ratchet 17 to prevent the load from being dropped suddenly. Gradual lifting of loads can be achieved by continuously turning the lever 40.

When lowering a load, the reversing ratchet pawl controlling end 16*a* on the lever 40 is first turned to the "DOWN" mode so that the reversing ratchet pawl is engaged with the reversing ratchet 16. The lever 40 is turned to control anticlockwise rotation of the reversing ratchet 16, the friction disk 18 between the reversing ratchet 16 and the brake ratchet 17 is disengaged to release braking of the long shaft 20 by the brake ratchet 17, the long shaft 20 is rotated clockwise under the effect of the load. While the long shaft 20 is rotated clockwise, the reversing ratchet 16 connected by threads is rotated anticlockwise with respect to the long shaft 20 and once the reversing ratchet 16 is rotated to abut the friction disk 18 between it and the brake ratchet 17, the brake ratchet 17 achieves braking of the long shaft 20. Gradual lowering of loads can be achieved by continuously turning the lever 40.

When the manual hoist is in idle mode, the reversing ratchet pawl controlling end 16*a* on the lever 40 is turned to the central position so that the reversing ratchet pawl is disengaged with the reversing ratchet 16, and the indicator point 121 of the hand wheel 12 is aligned with the initial state area 151*a*. As the hand wheel 12 and the long shaft 20 are both at an initial position, there is no pre-tightening force between the reversing ratchet 16 and the friction disk 18 on the brake ratchet 17, hence the brake ratchet 17 cannot achieve braking, and at this time rapid raising and lowering of the hoist chain 30 can be achieved by simply pulling the hoist chain 30.

Before lifting a load, the hand wheel 12 of the braking/clutching device 10 of the present invention firstly needs to be rotated to the operating state area 151*b* indicated by the indicator point 121, i.e. to achieve a pre-tightening force between the reversing ratchet 16 and the brake ratchet 17. When lowering a load, if the friction disk 18 is not worn at all, the gap between the reversing ratchet 16 and the brake ratchet 17 should be basically the same as that when it is in an initial state, at which time the indicator point 121 of the hand wheel 12 is aligned in the operating state area 151*b*. When the manual hoist has been used for a long time, the friction disks 18 wear down and the gap between the reversing ratchet 16 and the brake ratchet 17 becomes narrower. To narrow the gap, the reversing ratchet 16 will further rotate on the long shaft 20, at which time the long shaft 20 and the reversing ratchet 16 will have malposition. As the hand wheel 12 and the long shaft 20 are fixed circumferentially and the reversing ratchet 16 and the torsion spring block 15 are fixed by a bayonet connection, the hand wheel 12 and the torsion spring block 15 will also have a corresponding malposition, and the indicator point 121 on the hand wheel 12 is aligned in the worn state indicator area 151*c* on the torsion spring block 15, i.e. the friction disks 18 have worn down.

The more worn the friction disks 18, the narrower the gap between the reversing ratchet 16 and the brake ratchet 17 becomes; the larger the rotational space between the long shaft 20 and the reversing ratchet 16, the more quantifiable rotational malposition between the hand wheel 12 and the torsion spring block 15 will be. When the indicator point 121 is aligned in the worn state indicator area 151*c*, it is more deviated, or at a greater distance, from the operating state area 151*b*. If the position at which the indicator point 121 indicates is totally beyond the worn state indicator area 151*c*, then it indicates that the friction disks 18 need to be replaced. At this time, the manual hoist should be dismantled for replacement of the friction disks 18. The indication of the worn down friction disks 18 is provided without disassembly of the hoist 8.

As steel ball and spring devices 14 and concave detents 152 are disposed between the hand wheel 12 and the torsion spring block 15 to have the hand wheel 12 and the torsion spring block 15 clamped at the same circumferential position in an initial state, so that the hand wheel 12 and the torsion spring block 15 are allowed to rotate more readily with respect to each other when relative malposition between them occurs due to wear of the friction disks 18. The end face of the torsion spring block 15 is further provided with concave grooves 153 that are circumferentially disposed adjacent to the concave detents 152 and are shaped with the depth of the concave grooves 153 gradually increasing from adjacent the respective concave dents 152. The concave dents 152 correspond to the initial state area 151*a*, and the concave grooves 153 correspond to the operating state area 151*b* and the worn state area 151*c*. When the hand wheel 12 and the torsion spring block 15 have relative malposition, the ball and spring devices 14 can slide more readily in the concave grooves 153 since the grooves have gradually increasing depth. Friction disks that are not worn have sufficient thickness to prevent the movement of the ball and spring devices to the deeper portions of the grooves 153, so that the indicator of the hand wheel indicates friction disks with little or no wear.

When the indicator point 121 of the hand wheel 12 is in the operating state area 151*b* of the indicator area 151 on the torsion spring block 15, the reversing ratchet 16 is made to constantly press against the friction disks 18 due to the effect of the torsion spring 14. When there is no load the lever 40 may be directly moved or turned to raise the hoist chain 30 without having to manually pull up the hoist chain 30 to provide a lifting or lowering force.

When the indicator point 121 of the hand wheel 12 is in the initial state area 151*a* of the indicator area 151 on the torsion spring block 15, the hoist chain 30 is in idle mode and may be rapidly lowered. If the acceleration of the lowering hoist chain 30 is too large, then the reversing ratchet 16 cannot rotate coaxially with the long shaft 20 and the reversing ratchet 16 will automatically rotate inwardly toward the long shaft 20 to abut the friction disk 18. The indicator point 121 of the hand wheel 12 will automatically indicate at the operating state area 151*b*, for example, hence forming an automatic braking mechanism to prevent potential safety hazards caused by any excessive acceleration of the lowering hoist chain 30 in the idle mode.

When lowering a lighter tonnage load, the operator may move the indicator point 121 of the hand wheel 12 to indicate at the initial state area 151*a* of the indicator area 151 to achieve rapid lowering of the load, and this kind of operation is potentially hazardous. Therefore, if the acceleration becomes too large, then, as noted above, the reversing ratchet 16 cannot rotate coaxially with the long shaft 20 and the reversing ratchet 16 will automatically rotate inwardly toward the long shaft 20 to abut the friction disk 18, and the indicator point 121 of the hand wheel 12 will automatically indicate at the operating state area 151*b*, hence forming an automatic braking mechanism to prevent potential safety hazards caused by any erratic operation in idle mode.

Thus, there is shown and described a brake/clutch device for a manual hoist that has an externally-viewable indicator showing the wear status of friction elements within the hoist. The brake/clutch device has a brake block, a brake ratchet, a reversing ratchet, a torsion spring block, a hand wheel and a fastener mounted onto a main shaft of the manual hoist. Friction elements on the brake ratchet provide braking against sudden drops of a load. Ball and spring devices mounted in the hand wheel contact detents and grooves that gradually increase in depth in the torsion spring block depending on the relative positions of the hand wheel and the torsion spring block. The hand wheel has an indicator mark that may align with indicator areas of the torsion spring block to indicate an extent of wear of the friction elements Although other modifications and changes may be suggested by those skilled in the art, it is the intention of the inventors to embody within the patent warranted hereon all changes and modifications as reasonably and properly come within the scope of their contribution to the art.

We claim:

1. A braking/clutching device of a manual hoist, comprising:

an assembly including a brake block, a brake ratchet, a reversing ratchet, a torsion spring block, a hand wheel and a fastener circumferentially disposed successively on a long shaft of the manual hoist, the brake block fixing one end of the assembly and the fastener fixing the other end thereof;

the brake block and the long shaft being fixed circumferentially;

a friction disk provided on both sides of the brake ratchet;

the reversing ratchet and the long shaft being connected by threads;

a bayonet connection connecting the torsion spring block and the reversing ratchet are in a fixed circumferential connection;

a torsion spring mounted onto the long shaft at a position located between the torsion spring block and the hand wheel, the torsion spring having a first end coupled to the torsion spring block and the torsion spring having a second end coupled to the hand wheel;

steel ball and spring device disposed between the torsion spring block and the hand wheel and mounted i n the hand wheel, and the torsion spring block defining concave detents on an end face of the torsion spring block; the hand wheel and the long shaft being fixed circumferentially;

an indicator point on a surface of the hand wheel for indicating a position of the hand wheel; and an indicator area on an end face of the torsion spring block to indicate a relative position change between the hand wheel and the torsion spring block and for indicating a positional change of the indicator point.

2. A braking/clutching device according to claim 1, wherein the indicator area includes an initial state area, an operating state area and a worn state area which are successively disposed circumferentially on the torsion spring block.

3. A braking/clutching device according to claim 2, wherein the torsion spring block includes an end face that defines concave grooves that are circumferentially disposed adjacent to the concave detents, the concave grooves having a depth that gradually increases from adjacent the respective concave detents;

the concave detents corresponding to the initial state area, and the concave grooves corresponding to the operating state area and the worn state area.

4. A braking/clutching device according to claim 1, wherein the brake block fixed by steps on the long shaft, and wherein the fastener is a threaded nut.

5. A braking/clutching device according to claim 1, wherein the brake block and the long shaft are connected to one another by a first splined connection, and wherein the hand wheel and the long shaft are connected to one another by a second splined connection.

6. A braking/clutching device according to claim 1, wherein a circumferential surface of the torsion spring block includes knurled portions.

7. A braking/clutching device according to claim 1, wherein the concave detents are round holes provided with bushings to accommodate the steel ball and spring devices.

8. A braking/clutching device according to claim 1, wherein the brake ratchet is fitted on the brake block, and further comprising a ratchet bushing between the brake ratchet and the brake block.

* * * * *